US009022384B2

(12) United States Patent
Hasegawa et al.

(10) Patent No.: US 9,022,384 B2
(45) Date of Patent: May 5, 2015

(54) RECORDING-MATERIAL TRANSPORT APPARATUS AND RECORDING-MATERIAL TRANSPORT METHOD

(75) Inventors: Yousuke Hasegawa, Tokyo (JP); Michio Tada, Kanagawa (JP); Takashi Abe, Kanagawa (JP); Yoshiyuki Takaishi, Kanagawa (JP); Yoichi Yamakawa, Kanagawa (JP); Hisakazu Onoe, Kanagawa (JP); Makio Uehara, Kanagawa (JP); Yasunobu Gotoh, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 63 days.

(21) Appl. No.: 13/251,844

(22) Filed: Oct. 3, 2011

(65) Prior Publication Data

US 2012/0251212 A1 Oct. 4, 2012

(30) Foreign Application Priority Data

Mar. 29, 2011 (JP) ..... 2011-071756

(51) Int. Cl.
*B65H 9/06* (2006.01)
*G03G 15/00* (2006.01)
(Continued)

(52) U.S. Cl.
CPC ..... *G03G 15/6567* (2013.01); *B65H 5/062* (2013.01); *B65H 5/38* (2013.01); *B65H 7/10* (2013.01); *B65H 9/002* (2013.01); *B65H 9/004* (2013.01); *B65H 9/06* (2013.01); *B65H 9/106* (2013.01); *B65H 85/00* (2013.01); *B65H 2301/3122* (2013.01); *B65H 2301/33212* (2013.01); *B65H 2301/33224* (2013.01); *B65H 2404/14* (2013.01); *B65H 2404/1441* (2013.01); *B65H 2404/6111* (2013.01); *B65H 2511/20* (2013.01); *B65H 2511/242* (2013.01);
(Continued)

(58) Field of Classification Search
CPC ..... B65H 9/06; B65H 9/106; B65H 2220/15; B65H 2404/725; B65H 2404/1424; B65H 2301/3621
USPC ..... 271/249, 184, 225, 229, 236, 239, 238, 271/242, 243, 245, 246
See application file for complete search history.

(56) References Cited

U.S. PATENT DOCUMENTS 4,685,664 A * 8/1987 Petersdorf ..... 271/227
4,805,892 A * 2/1989 Calhoun ..... 271/225
(Continued)

FOREIGN PATENT DOCUMENTS

JP 2000-233853 A 8/2000
JP B2-3268329 3/2002
(Continued)

OTHER PUBLICATIONS

Nov. 18, 2014 Office Action issued in Japanese Patent Application No. 2011-071756.

*Primary Examiner* — Patrick Cicchino
(74) *Attorney, Agent, or Firm* — Oliff PLC

(57) ABSTRACT

A recording-material transport apparatus includes a transport unit that transports a recording material, a detector that detects a position of the recording material in intersecting directions intersecting a transport direction in which the recording material is transported by the transport unit, and a moving member that moves the recording material transported by the transport unit to a predetermined position in a predetermined one of the intersecting directions on the basis of a detection result of the detector.

8 Claims, 8 Drawing Sheets

(51) Int. Cl.

| | |
|---|---|
| ***B65H 5/06*** | (2006.01) |
| ***B65H 5/38*** | (2006.01) |
| ***B65H 7/10*** | (2006.01) |
| ***B65H 9/00*** | (2006.01) |
| ***B65H 9/10*** | (2006.01) |
| ***B65H 85/00*** | (2006.01) |
| *G03G 15/23* | (2006.01) |

(52) U.S. Cl.

CPC ... *B65H2511/514* (2013.01); *B65H 2701/1315* (2013.01); *G03G 2215/00438* (2013.01); *G03G 2215/00561* (2013.01); *G03G 2215/00616* (2013.01); *G03G 2215/00721* (2013.01); *G03G 2215/0125* (2013.01); *G03G 15/235* (2013.01)

(56) References Cited

U.S. PATENT DOCUMENTS

| | | | | | |
|---|---|---|---|---|---|
| 4,823,159 | A * | 4/1989 | Yamamoto et al. | ..... | 399/394 |
| 4,903,043 | A * | 2/1990 | Tajima | ..... | 346/134 |
| 5,042,791 | A * | 8/1991 | Stemmle | ..... | 271/186 |
| 5,052,678 | A * | 10/1991 | Looney | ..... | 271/186 |
| 5,219,159 | A * | 6/1993 | Malachowski et al. | ..... | 271/228 |
| 6,736,394 | B2 * | 5/2004 | Herrmann et al. | ..... | 271/249 |
| 7,722,039 | B2 * | 5/2010 | Shoji et al. | ..... | 271/273 |
| 7,753,370 | B2 * | 7/2010 | Inoue | ..... | 271/239 |
| 7,986,912 | B2 * | 7/2011 | Maruyama | ..... | 399/394 |
| 8,205,878 | B2 * | 6/2012 | Masuda | ..... | 271/249 |
| 8,213,851 | B2 * | 7/2012 | Shoji et al. | ..... | 399/395 |
| 2001/0014235 | A1 | 8/2001 | Ando et al. | | |
| 2003/0146567 | A1 * | 8/2003 | Williams et al. | ..... | 271/249 |
| 2006/0012112 | A1 | 1/2006 | Kitazawa | | |
| 2006/0255531 | A1 * | 11/2006 | Azzopardi et al. | ..... | 271/171 |
| 2007/0296141 | A1 * | 12/2007 | Inoue | ..... | 271/226 |
| 2008/0003031 | A1 * | 1/2008 | Tsuchiya et al. | ..... | 399/361 |
| 2008/0232877 | A1 | 9/2008 | Ishida et al. | | |
| 2008/0232879 | A1 * | 9/2008 | Shoji et al. | ..... | 399/395 |
| 2008/0240821 | A1 | 10/2008 | Shoji et al. | | |
| 2009/0060608 | A1 * | 3/2009 | Shoji et al. | ..... | 399/394 |

FOREIGN PATENT DOCUMENTS

| | | | |
|---|---|---|---|
| JP | 2006-027811 | A | 2/2006 |
| JP | 2007-031041 | A | 2/2007 |
| JP | 2008-233446 | A | 10/2008 |

* cited by examiner

R2
48B
48C
48A
48
HK2
30
R1
P
HK1
SK1
SK2
44
P
300
P
48B
48C
48A
48
P
R4
EXTENSION LINE
OF TRANSPORT
REFERENCE HK2
48B
48C
48A
42
410, 420
P

RECORDING-MATERIAL TRANSPORT APPARATUS AND RECORDING-MATERIAL TRANSPORT METHOD

CROSS-REFERENCE TO RELATED APPLICATIONS

This application is based on and claims priority under 35 USC 119 from Japanese Patent Application No. 2011-071756 filed Mar. 29, 2011.

BACKGROUND (i) Technical Field

The present invention relates to a recording-material transport apparatus and a recording-material transport method.

(ii) Related Art

Various apparatuses for correcting positional deviation of a recording material have been proposed hitherto.

SUMMARY

According to an aspect of the invention, there is provided a recording-material transport apparatus including a transport unit that transports a recording material; a detector that detects a position of the recording material in intersecting directions intersecting a transport direction in which the recording material is transported by the transport unit; and a moving member that moves the recording material transported by the transport unit to a predetermined position in a predetermined one of the intersecting directions on the basis of a detection result of the detector.

BRIEF DESCRIPTION OF THE DRAWINGS

Exemplary embodiment(s) of the present invention will be described in detail based on the following figures, wherein.

DETAILED DESCRIPTION

An exemplary embodiment of the present invention will be described in detail below with reference to the attached drawings.

Figure 1:
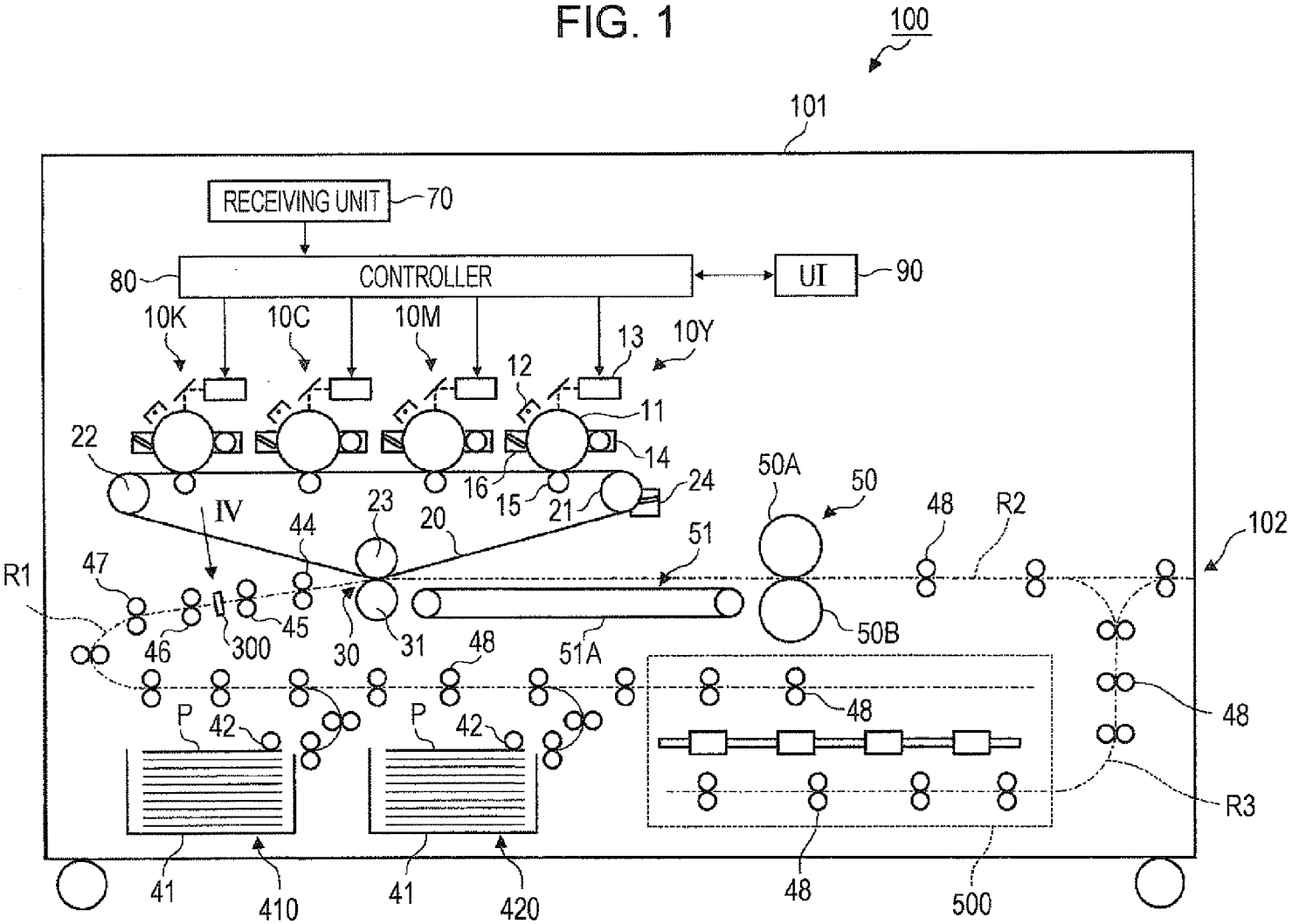
FIG. 1 is a cross-sectional front view of an image forming apparatus according to an exemplary embodiment.

FIG. 1 is a cross-sectional front view of an image forming apparatus 100 according to the exemplary embodiment. The image forming apparatus 100 illustrated in FIG. 1 is of a so-called tandem type, and includes plural image forming units 10 (10Y, 10M, 10C, and 10K) that form toner images of color components by means of electrophotography. The image forming apparatus 100 of the exemplary embodiment further includes a controller 80 that has a central processing unit (CPU), a read only memory (ROM), etc. and that controls operations of devices and sections provided in the image forming apparatus 100.

The image forming apparatus 100 further includes a user interface unit (UI) 90 formed by a display panel. The UI 90 outputs instructions received from the user to the controller 80, and presents information from the controller 80 to the user. The image forming apparatus 100 further includes a receiving unit 70 that receives image data from a personal computer (PC) and an image reading apparatus (scanner). The image forming apparatus 100 further includes an intermediate transfer belt 20 on which color component toner images formed by the image forming units 10 functioning as a part of an image forming section are sequentially transferred (first transfer) and the toner images are held, and a second transfer device 30 that transfers the toner images together from the intermediate transfer belt 20 onto a rectangular sheet P (second transfer).

The image forming apparatus 100 further includes a first sheet transport path R1 through which a sheet P is transported toward the second transfer device 30, and a second sheet transport path R2 through which the sheet P is transported after passing through the second transfer device 30. The image forming apparatus 100 further includes a third sheet transport path R3 branching off from the second sheet transport path R2 on a downstream side of a fixing device 50 (described below) and extending below the first sheet transport path R1. A part of the third sheet transport path R3 extends parallel to the first sheet transport path R1 serving as an example of a transport path. The part of the third sheet transport path R3 serves as a parallel path extending parallel to the first sheet transport path R1. In the first to third transport paths R1 to R3 of the exemplary embodiment, the sheet P is transported so that two opposing sides (one side and the other side opposite the one side), of four sides of the sheet P1, move along these sheet transport paths.

In the exemplary embodiment, a reverse mechanism 500 is provided as an example of a supply unit that transports a sheet P from the third sheet transport path R3 to the first sheet transport path R1 and transports the sheet P to the first sheet transport path R1 after turning the sheet P upside down. In other words, in the exemplary embodiment, the reverse mechanism 500 turns the sheet P on an axis along a sheet transport direction in the first sheet transport path R1 and a sheet transport direction in the third sheet transport path R3.

Further, in the exemplary embodiment, a housing 101 of the image forming apparatus 100 has an opening 102. Sheets P transported along the second sheet transport path R2 are output from the housing 101 through the opening 102, and are stacked on an unillustrated sheet stack portion. A handling device (not illustrated) may be provided adjacent to the housing 101, for example, so as to punch the sheets P output from the opening 102.

The image forming apparatus 100 further includes a first sheet supply device 410 that supplies sheets P to the first sheet transport path R1. On an upstream side of the first sheet supply device 410 in the sheet transport direction, a second sheet supply device 420 is provided to supply sheets P to the first sheet transport path R1. The first sheet supply device 410 and the second sheet supply device 420 are similar in structure, and each include a sheet storage portion 41 that stores sheets P and a feed roller 42 that feeds out and transports the sheets P from the sheet storage portion 41.

In the first sheet transport path R1 and on an upstream side of the second transfer device 30, a first transport roller 44 is provided to transport a sheet P from the first sheet transport path R1 toward the second transfer device 30. Further, a second transport roller 45 for transporting the sheet P toward the first transport roller 44, a third transport roller 46 for transporting the sheet P toward the second transport roller 45, and a fourth transport roller 47 for transporting the sheet P toward the third transport roller 46 are provided.

Besides these transport rollers, plural transport rollers 48 for transporting the sheet P are provided in the first, second, and third sheet transport paths R1, R2, and R3. The first transport roller 44, the second transport roller 45, the third transport roller 46, the fourth transport roller 47, and the transport rollers 48 are each include a pair of rotatable roll-shaped members that are pressed against each other. One of the roll-shaped members is rotated to transport the sheet P.

In the exemplary embodiment, an abutment member 300 with which a leading end of a sheet P is to contact is provided between the second transport roller 45 and the third transport roller 46. In the exemplary embodiment, the leading end of the sheet P contacts with the abutment member 300, whereby the sheet P is corrected for skew (tilt of the sheet P from the transport direction is corrected). The abutment member 300 retracts from the first sheet transport path R1 after correcting the sheet P for skew. In the exemplary embodiment, a fixing device 50 is provided in the second sheet transport path R2 so as to fix, on the sheet P, images transferred on the sheet P by the second transfer device 30.

Between the second transfer device 30 and the fixing device 50, a transport device 51 is provided to transport the sheet P passing through the second transfer device 30 to the fixing device 50. The transport device 51 includes a circulating belt 51A that transports the sheet P while holding the sheet P thereon. The fixing device 50 includes a heating roller 50A to be heated by a built-in heater (not illustrated) and a pressing roller 50B for pressing the heating roller 50A. In the fixing device 50, the sheet P is heated and pressurized while passing between the heating roller 50A and the pressing roller 50B, so that the images on the sheet P are fixed.

Each of the image forming units 10 includes a rotatable photoconductor drum 11. Around the photoconductor drum 11, a charging device 12 for charging the photoconductor drum 11, an exposure device 13 for writing an electrostatic latent image on the photoconductor drum 11 by exposing the photoconductor drum 11, and a developing device 14 for developing the electrostatic latent image on the photoconductor drum 11 with toner into a visible image are arranged. Further, each of the image forming units 10 includes a first transfer device 15 for transferring color component toner images from the photoconductor drum 11 onto the intermediate transfer belt 20, and a drum cleaning device 16 for removing residual toner from the photoconductor drum 11.

The intermediate transfer belt 20 is rotatably stretched around three roll members 21 to 23. Of the three roll members 21 to 23, the roll member 22 drives the intermediate transfer belt 20, and the roll member 23 opposes the second transfer roller 31 with the intermediate transfer belt 20 being disposed therebetween. The second transfer roller 31 and the roll member 23 constitute the second transfer device 30. At a position opposing the roll member 21 with the intermediate transfer belt 20 being disposed therebetween, a belt cleaning device 24 is provided to remove residual toner from the intermediate transfer belt 20.

The image forming apparatus 100 of the exemplary embodiment forms an image not only on a first surface of a sheet P supplied from the first sheet supply device 410 or the like but also on a second surface of the sheet P. More specifically, in the image forming apparatus 100, the sheet P passing through the fixing device 50 is turned upside down by the reverse mechanism 500, and the turned sheet P is transported again to the second transfer device 30, where an image is transferred on the second surface of the sheet P. After that, the sheet P passes through the fixing device 50 again, and the transferred image is fixed on the sheet P. Thus, an image is formed not only on the first surface of the sheet P but also on the second surface of the sheet P.

Figure 2:
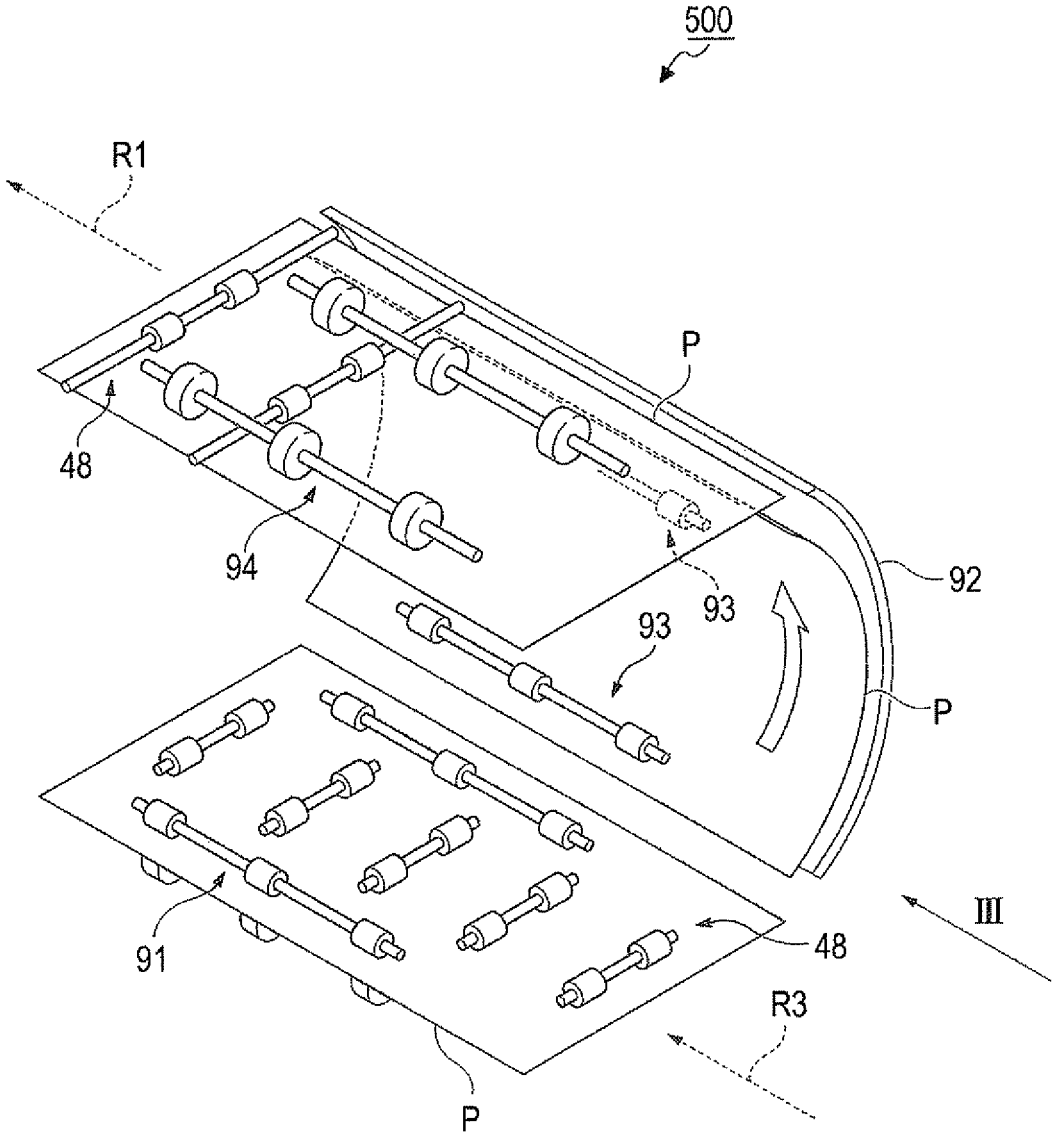
FIG. 2 illustrates a reverse mechanism.

FIG. 2 illustrates the reverse mechanism 500.

As described above, in the reverse mechanism 500 also functioning as a first recording-material moving unit, plural transport rollers 48 for transporting a sheet P along the third sheet transport path R3 are provided in the third sheet transport path R3, as described above. Further, plural transport rollers 48 for transporting the sheet P along the first sheet transport path R1 are provided in the first sheet transport path R1. In the third sheet transport path R3, transport rollers 91 are also provided to transport the sheet P in a direction orthogonal to (intersecting) the transport direction of the sheet P in the third sheet transport path R3. In other words, the transport rollers 91 transport the sheet P in the lateral direction of the third sheet transport path R3.

In the exemplary embodiment, a guide member 92 is provided to guide a sheet P transported by the transport rollers 91 so that the sheet P moves upward and then further moves toward the first sheet transport path R1. In other words, the guide member 92 guides the sheet P, which is transported in the direction intersecting the transport direction of the sheet P in the third sheet transport path R3, so that the sheet P returns toward a side where the third sheet transport path R3 is provided.

Further, in the exemplary embodiment, transport rollers 93 are provided to nip the sheet P, which is guided by the guide member 92 with its leading end pointing upward, and to transport the sheet P further upward. In the first sheet transport path R1, transport rollers 94 are provided to transport the sheet P transported by the transport rollers 93 to a predetermined position in the first sheet transport path R1. Although not illustrated, a driving motor is provided to rotate the transport rollers 48, the transport rollers 91, the transport rollers 93, and the transport rollers 94. This driving motor is formed by a stepper motor.

As described above, each of the transport rollers 48 includes a pair of roll-shaped members. Each of the transport rollers 91, the transport rollers 93, and the transport rollers 94 also includes a pair of roll-shaped members that are pressed against each other. FIG. 2 illustrates only one of the pair of roll-shaped members provided in each of the transport roller 48, the transport rollers 91, the transport rollers 93, and the transport rollers 94.

In the exemplary embodiment, one of the roll-shaped members provided in each of the transport rollers 48 is separable from the other roll-shaped member. Similarly, one roll-shaped member is separable from the other roll-shaped member in each of the transport rollers 91 and the transport rollers 94. Although not illustrated, a separation mechanism is provided to separate one roll-shaped member from the other roll-shaped member. The separation mechanism includes existing structures such as a motor and a cam.

When a sheet P is turned upside down by the reverse mechanism 500, it is first transported along the third sheet transport path R3 by the transport rollers 48. In this case, one roll-shaped member in each of the transport rollers 91 provided in the third sheet transport path R3 is separate from the other roll-shaped member. Next, one roll-shaped member in each of the transport rollers 48 separates from the other roll-shaped member, and the one roll-shaped member in each of the transport rollers 91 is pressed against the other roll-shaped member with the sheet P being disposed therebetween.

Subsequently, the transport rollers 91, the transport rollers 93, and the transport rollers 94 are rotated to transport the sheet P toward the first sheet transport path R1. At this time, one roll-shaped member in each of the transport rollers 48 provided in the first sheet transport path R1 is separate from the other roll-shaped member. When the sheet P is transported to the predetermined position in the first sheet transport path R1, rotations of the transport rollers 91, the transport rollers 93, and the transport rollers 94 are stopped. After that, one roll-shaped member in each of the transport rollers 94 separates from the other roll-shaped member, and the one roll-shaped member in each of the transport rollers 48 provided in the first sheet transport path R1 is pressed against the other roll-shaped member with the sheet P being disposed therebetween.

Next, the transport rollers 48 are rotated to transport the sheet P along the first sheet transport path R1. At this time, the sheet P has already been turned upside down. In the reverse mechanism 500 of the exemplary embodiment, the sheet P is turned upside down without changing places of the leading end and the trailing end of the sheet P with each other in the transport direction. On the other hand, in the reverse mechanism 500 of the exemplary embodiment, places of one side and the other side of the sheet P are changed.

Figure 3:
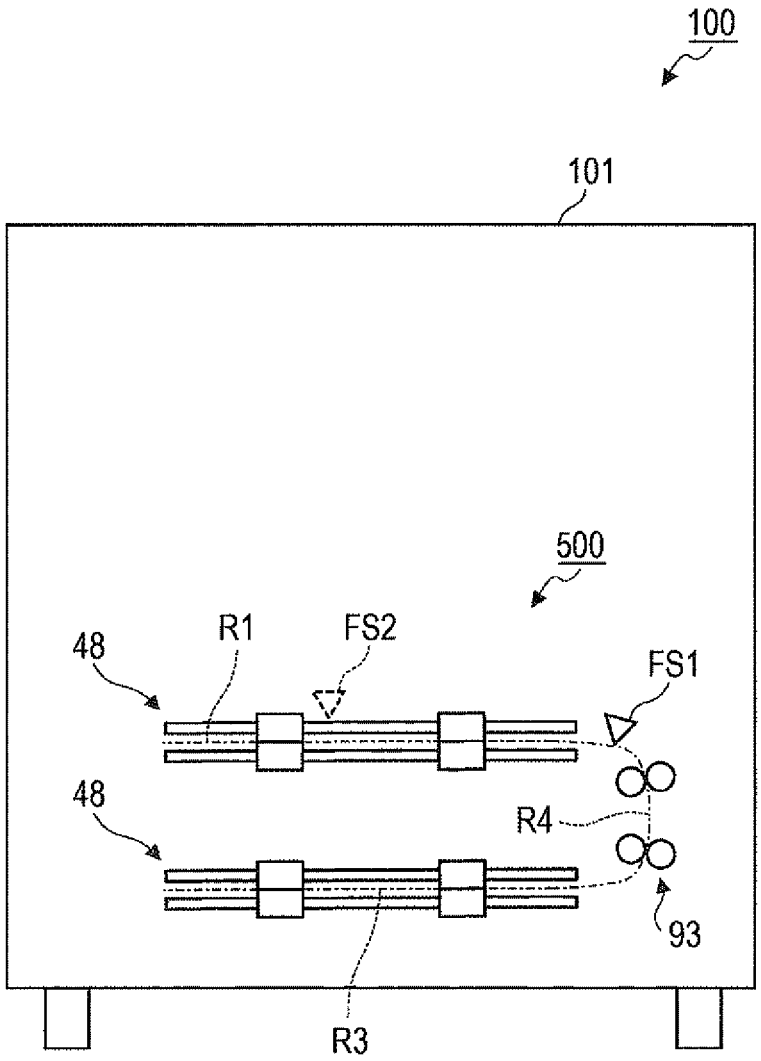
FIG. 3 is a view on arrow III of FIG. 2 illustrating the reverse mechanism.

FIG. 3 is a view on arrow III of FIG. 2 illustrating the reverse mechanism 500. In FIG. 3, the transport rollers 91, the transport rollers 94, and the guide member 92 illustrated in FIG. 2 are not illustrated.

Although not illustrated in FIG. 2, the reverse mechanism 500 of the exemplary embodiment includes a fourth sheet transport path R4 that connects the third sheet transport path R3 and the first sheet transport path R1, and a detection sensor FS1 is provided in the fourth sheet transport path R4 so as to detect a leading end of the sheet P transported along the fourth sheet transport path R4, as illustrated in FIG. 3. In the exemplary embodiment, the sheet P is transported in the first to third sheet transport paths R1 to R3 so that two sides of the sheet P move along these sheet transport paths. In contrast, in the fourth sheet transport path R4, the sheet P is transported in a state in which one of the sides leads. The sheet P is then supplied to the first sheet transport path R1 from the lateral side of the first sheet transport path R1.

In the exemplary embodiment, the unillustrated driving motor is driven by a predetermined number of steps after the leading end of the sheet P is detected by the detection sensor FS1, and is then stopped, so that the sheet P is transported to the predetermined position in the first sheet transport path R1, as described above. The detection sensor FS1 may be formed by a so-called reflective sensor including a light emitting element and a light receiving element, or a so-called transmissive sensor in which a light emitting element is located on one side of the fourth sheet transport path R4 and a light receiving element is located on the other side.

Figure 4:
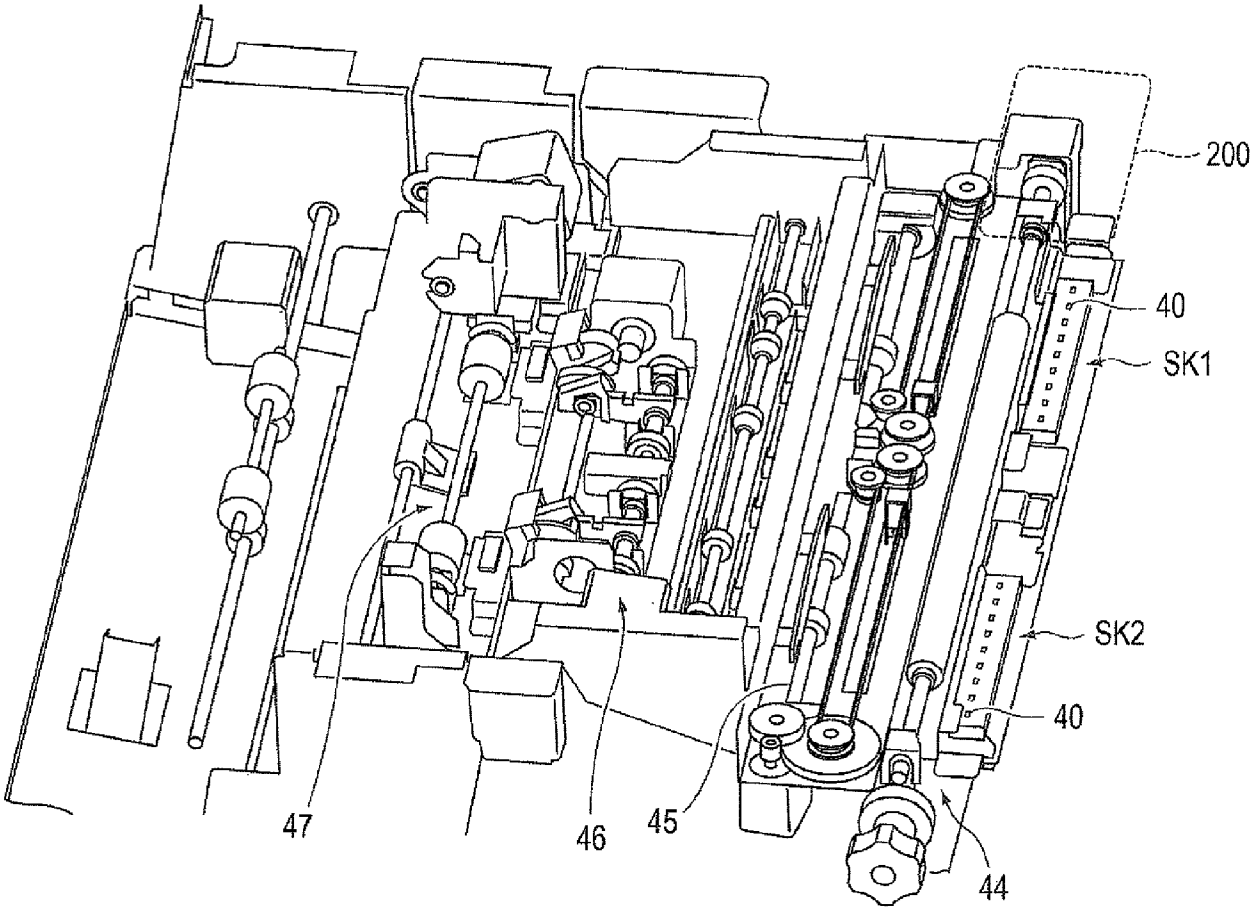
FIG. 4 is a view on arrow IV of FIG. 1 illustrating a first sheet transport path.

FIG. 4 is a view on arrow IV of FIG. 1 illustrating the first sheet transport path R1. In FIG. 4, the abutment member 300 of FIG. 1 is not illustrated.

As illustrated in FIG. 4, a first side detection sensor SK1 and a second side detection sensor SK2 are provided downstream of the first transport roller 44 so as to detect sides of the sheet P transported along the first sheet transport path R1. The first side detection sensor SK1 is located on the rear side of the image forming apparatus 100, and the second side detection sensor SK2 is located on the front side of the image forming apparatus 100.

In the first side detection sensor SK1 and the second side detection sensor SK2 serving as an example of a detector, plural light receiving elements 40 are arranged in the direction orthogonal to the transport direction of the sheet P. In the exemplary embodiment, plural light sources (not illustrated), such as LEDs, arranged in a direction in which the light receiving elements 40 are arranged apply irradiation light onto the sheet P, and the light receiving elements 40 receive reflected light from the sheet P. In the exemplary embodiment, signals obtained by the light receiving elements 40 are binarized, and points where the density level changes after binarization are detected as sides of the sheet P.

Figure 5:
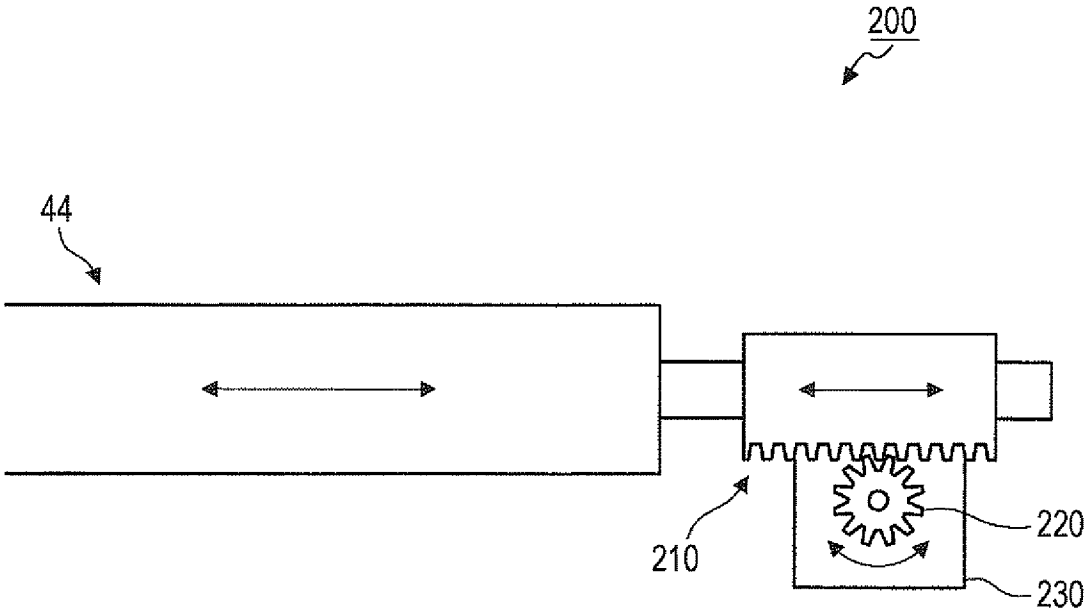
FIG. 5 illustrates a moving mechanism.

In the exemplary embodiment, the first transport roller 44 is movable in the direction orthogonal to the transport direction of the sheet P. As illustrated in FIG. 5, the first transport roller 44 is shifted by a moving mechanism 200 that includes a rack gear 210 attached to an end of the first transport roller 44, a pinion gear 220 meshed with the rack gear 210, and a gear motor 230 for rotating the pinion gear 220. In the exemplary embodiment, by rotating the gear motor 230 in forward and reverse directions, the first transport roller 44 is shifted in the direction orthogonal to the transport direction of the sheet P (axial direction of the first transport roller 44).

FIGS. 6A to 6E illustrate states of the sheet P transported in the image forming apparatus 100.

Figures 6A, 6B, 6C, 6D, 6E:
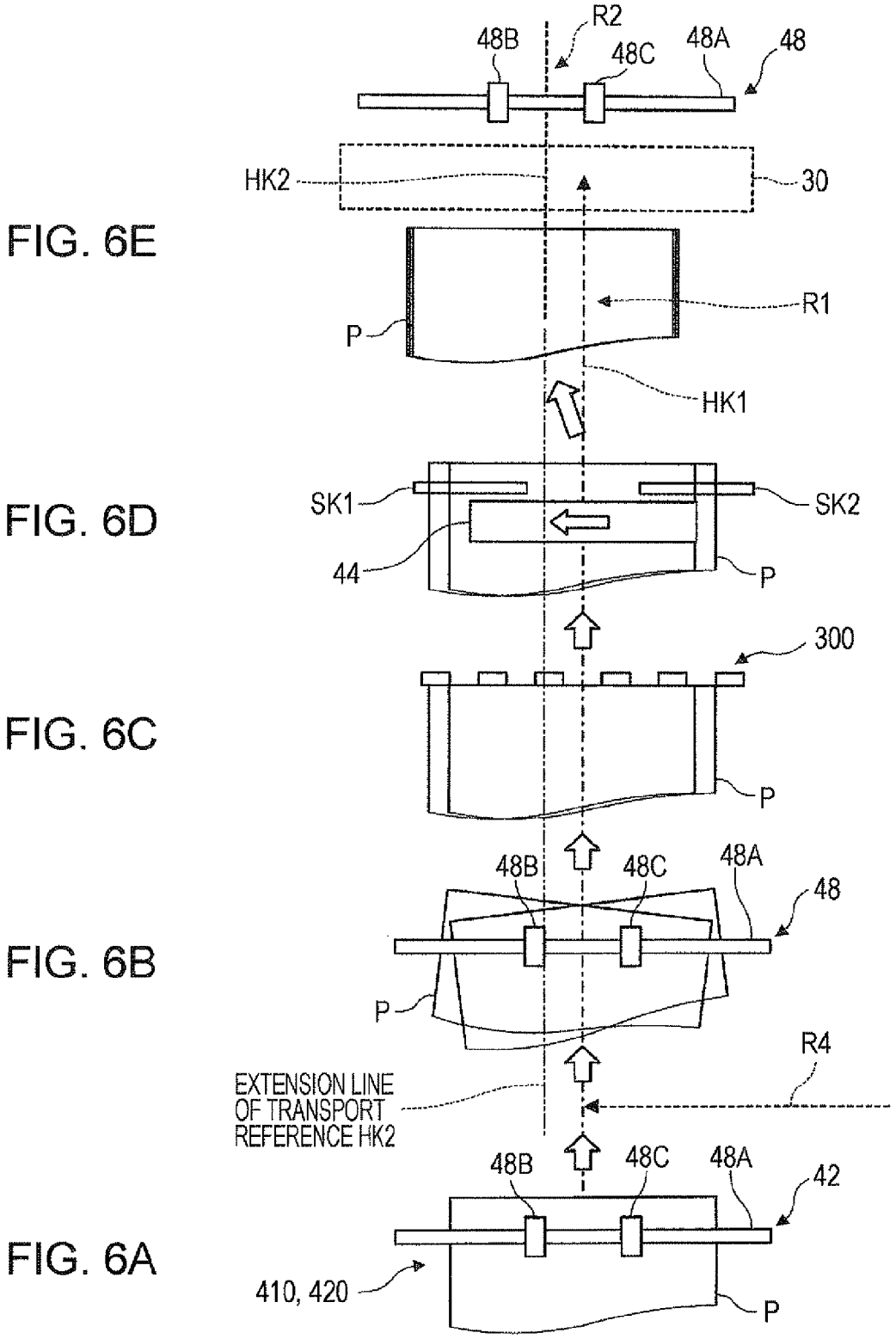
FIGS. 6A to 6E illustrate states of a sheet transported in the image forming apparatus.

In the exemplary embodiment, as illustrated in FIG. 6A, the feed roller 42 (see FIG. 1) provided in the first sheet supply device 410 or the second sheet supply device 420 is rotated to supply a sheet P to the first sheet transport path R1. After that, as illustrated in FIG. 62, the sheet P is transported further downstream by the transport rollers 48 serving as an example of a transport unit. In the first sheet transport path R1, the sheet P is transported so that a center portion of the sheet P (center portion in the direction orthogonal to the transport direction of the sheet P, center position) is aligned with a transport reference HK1 (shown by a one-dot chain line in the figures) provided along the first sheet transport path R1.

Although not described above, as illustrated in FIG. 6B, each transport roller 48 includes a shaft 48A extending in the direction orthogonal to the transport direction of the sheet P so as to be rotated by the unillustrated motor, and columnar first and second rotating members 48B and 48C that corotate with the shaft 48A and have outer peripheral surfaces to contact with the sheet P. Similarly, the feed roller 42 includes a shaft 48A, a first rotating member 48B, and a second rotating member 48C (see FIG. 6A).

After that, in the exemplary embodiment, as illustrated in FIG. 6C, a leading end of the sheet P contacts with the abutment member 300 so as to be corrected for skew. Next, in the exemplary embodiment, as illustrated in FIG. 6D, the sheet P reaches the first side detection sensor SK1, and one side of the sheet P is detected by the first side detection sensor SK1. After that, the first transport roller 44 that is rotating while nipping the sheet P is shifted in one direction (to the left in the figure), and is stopped at a predetermined position.

Thus, as illustrated in FIG. 6E, the sheet P is transported so that the center portion of the sheet P moves along a transport reference HK2 different from the transport reference HK1. In other words, the sheet P is transported so that the center portion of the sheet P moves along the transport reference HK2 parallel to the transport reference HK1. After that, the sheet P reaches the second transfer device 30, where a toner image is transferred onto the sheet P. Then, the sheet P is transported along the second sheet transport path R2 by the transport rollers 48 provided in the second sheet transport path R2, and passes through the fixing device 50. After that, when an image is not to be formed on a second surface (an image is formed on only one surface), the sheet P is output to the outside from the opening 102 (see FIG. 1).

The amount by which the first transport roller 44 functioning as a moving member and a second recording-material moving member is shifted in the one direction (to the left) is determined on the basis of a detection result of the first side detection sensor SK1. The first transport roller 44 is shifted by the determined moving amount, and the sheet P correspondingly moves. This prevents the position of an image on the sheet P from being misregistered from a position intended by the user.

Figure 7:
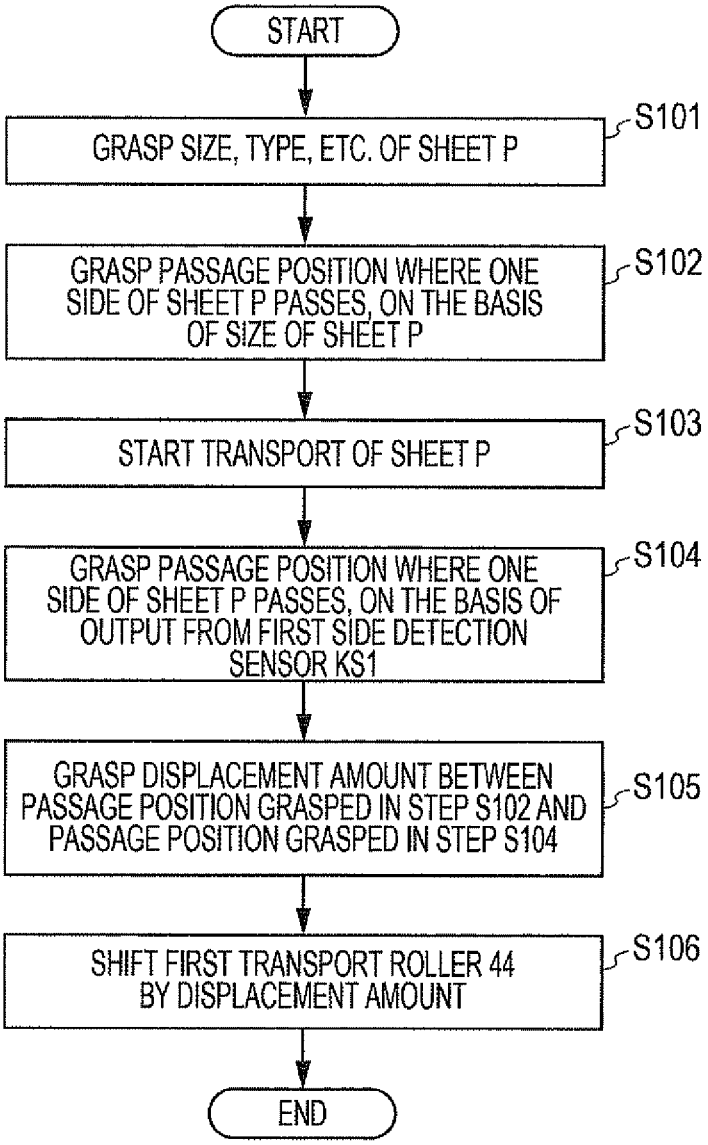
FIG. 7 is a flowchart showing a procedure performed by a controller.

A process for moving the sheet P with the first transport roller 44 will be described in detail with reference to FIG. 7 (a flowchart showing a procedure performed by the controller 80). In the exemplary embodiment, first, the controller 80 (see FIG. 1) acquires information about the sheet P such as the size and type of the sheet P (Step S101). The information about the sheet P is grasped on the basis of information input through the UI 90 (see FIG. 1) by the user and information received by the receiving unit 70.

Next, the controller 80 grasps a passage position where one side of the sheet P passes when being transported along the transport reference HK2, on the basis of the grasped size of the sheet P (Step S102). In other words, the controller 80 grasps an estimated passage position where one side of the sheet P will pass when being transported along the transport reference HK2. The passage position (estimated passage position) is grasped, for example, by reference to a lookup table (LUT) prestored in a ROM so as to specify the relationship between the size of the sheet P and the passage position. After that, transport of the sheet P is started (Step S103).

After the start of transport, the sheet P reaches the first side detection sensor SK1. In this case, the controller 80 grasps a passage position of the one side of the sheet P on the basis of output from the first side detection sensor SK1 (Step S104). After that, the controller 80 grasps a displacement amount (difference) between the passage position grasped in Step S102 and the passage position grasped in Step S104 (Step S105). Then, the controller 80 shifts the first transport roller 44 by an amount corresponding to the grasped displacement amount (Step S106). More specifically, the controller 80 drives the moving mechanism 200 (see FIG. 5) to shift the first transport roller 44. Thus, the sheet P passes through the predetermined position, and an image is formed at a position intended by the user.

While an image is formed on a first surface of the sheet P in the above, when an image is also formed on a second surface of the sheet P (images are formed on both surfaces), the sheet P is transported along the third sheet transport path R3 (see FIG. 1) after passing through the fixing device 50. After that, the sheet P is turned upside down by the reverse mechanism 500, and is transported again to the first sheet transport path R1 through the fourth sheet transport path R4 (see FIG. 63).

The sheet P transported from the fourth sheet transport path R4 is temporarily stopped in the first sheet transport path R1. In this case, the sheet P is stopped so that a center portion of the sheet P (a center portion in the direction orthogonal to the sheet transport direction in the first sheet transport path R1) is aligned with the transport reference HK1. In other words, the sheet P is stopped so that the center portion of the sheet P is located short of an extension line of the transport reference HK2 (shown by a two-dot chain line of FIGS. 6A to 6E).

If the center portion of the sheet P is not aligned with the transport reference HK1, and for example, if the center portion is aligned with the extension line of the transport reference HK2, movement of the sheet P to the left (movement of the sheet P in one direction) is difficult. In this case, the position of the sheet P is apt to vary after the sheet P is moved by the first transport roller 44 (the reason will be described below).

For this reason, in the exemplary embodiment, transport of the sheet P is thus stopped so that the center portion of the sheet P is aligned with the transport reference HK1. While the sheet P is shifted to the left in the exemplary embodiment, as illustrated in FIGS. 6D and 6E, the transport reference HK1 may be provided on a left side of the transport reference HK2 so that the sheet P is shifted to the right in the figures. In this case, the sheet P transported from the fourth sheet transport path R4 to the first sheet transport path R1 is stopped when the center portion thereof reaches a position beyond the transport reference HK2.

In the exemplary embodiment, when an image is to be formed on the second surface of the sheet P (the sheet P turned by the reverse mechanism 500), the same side of the sheet P as the side detected when an image is formed on the first surface of the sheet P is detected by the second side detection sensor SK2, not by the first side detection sensor SK1. In other words, the second side detection sensor SK2 is used instead of the first side detection sensor SK1, and the above-described one side, which has been detected by the first side detection sensor SK1, is detected again by the second side detection sensor SK2. Similarly to the above, the first transport roller 44 is shifted by an amount corresponding to a displacement amount between the passage position (estimated passage position) of the one side grasped on the basis of the size of the sheet P and a passage position grasped on the basis of a detection result of the second side detection sensor SK2.

In the exemplary embodiment, the sheet P sometimes expands or contracts after the first detection of the side (after an image is formed on the first surface) because the sheet P passes through the fixing device 50. Further, while the sheet P is generally obtained by cutting, the length of the sheet P is sometimes different from a predetermined standard value, for example, because of cutting error. In this case, if a side different from a side detected in the first detection is detected in the second detection and the first transport roller 44 is shifted on the basis of a result of the second detection, it is difficult to register images on the first and second surfaces of the sheet P.

Accordingly, in the exemplary embodiment, the second side detection sensor SK2 is provided in addition to the first side detection sensor SK1, and the same side as the side detected in the first detection is also detected in the second detection. In other words, in the exemplary embodiment, the side of the sheet P serving as a reference used to move the sheet P in the axial direction of the first transport roller 44 using the first transport roller 44 is the same between the first and second surfaces of the sheet P.

FIGS. 8A to 8E illustrate a comparative example of a transport manner of a sheet P. Components having functions similar to those adopted in the above exemplary embodiment are denoted by the same reference numerals, and descriptions thereof are skipped.

Figures 8A, 8B, 8C, 8D, 8E:
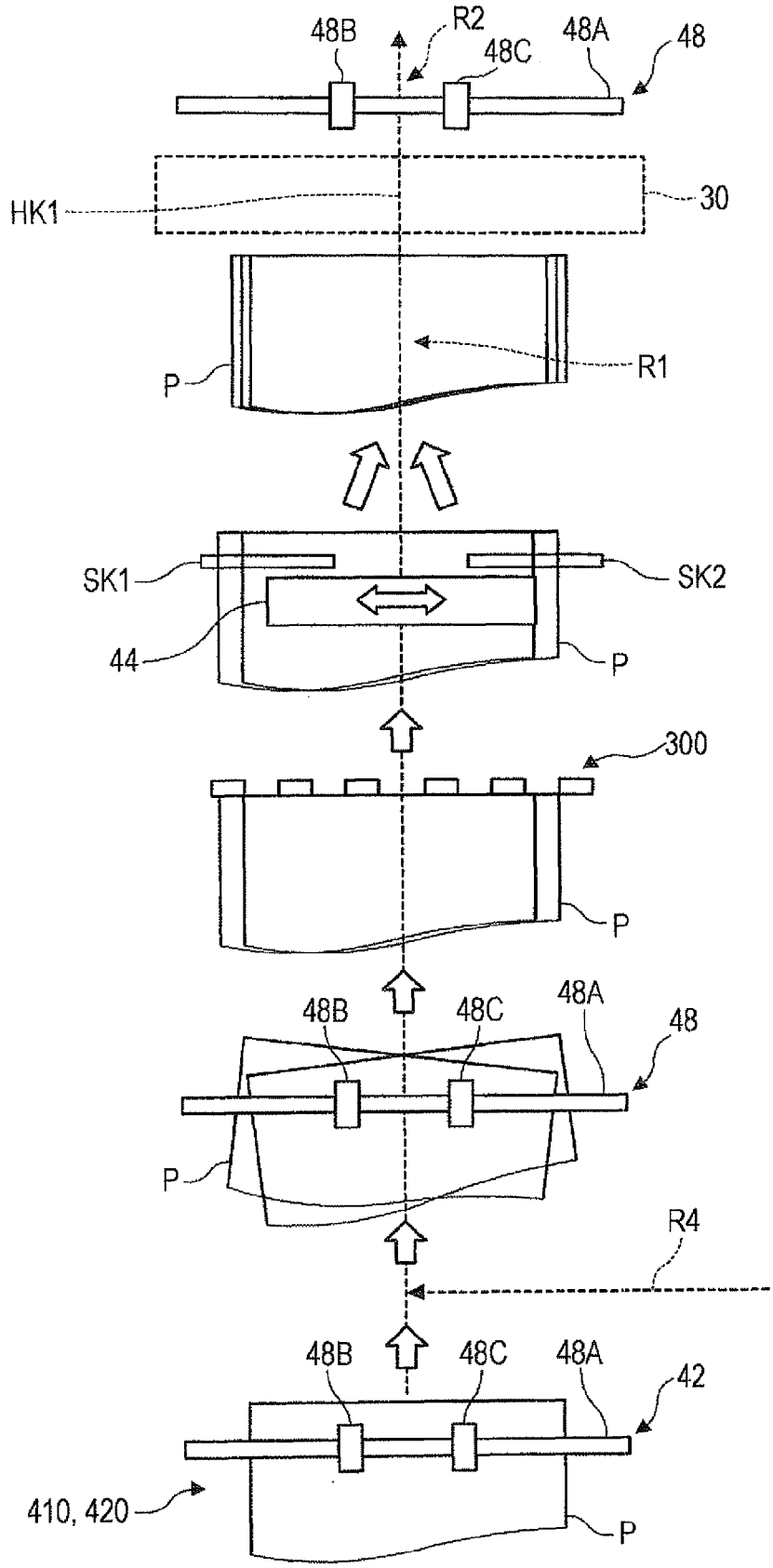
FIGS. 8A to 8E illustrate a comparative example of a sheet transport manner.

In the comparative example illustrated in FIGS. 8A to 8E, the above-described transport reference HK2 is not provided, but only a single transport reference HK1 is provided. In other words, the transport reference used when a sheet P passes through the second transfer device 30 coincides with the transport reference of the sheet P in the first sheet transport path R1. For this reason, the first transport roller 44 is shifted to both the right and left in order to move the sheet P that deviates in the direction orthogonal to the transport direction. In this case, as illustrated in FIG. 8E, the position of the sheet P moved by the first transport roller 44 more easily varies than in the exemplary embodiment (see FIG. 6E).

The behavior of the first transport roller 44 during movement to the left does sometimes not coincide with the behavior thereof during movement to the right. In other words, the behavior of the first transport roller 44 during movement to the left is sometimes different from the behavior thereof during movement to the right owing to mechanical error and frictional resistance. In this case, the behavior of the sheet P moved to the left by the first transport roller 44 is also different from the behavior of the sheet P moved to the right by the first transport roller 44, and the arrival distance of the sheet P is different between when the sheet P is moved to the left and when the sheet P is moved to the right. In this case, as described above, the position of the sheet P varies after the sheet P is moved by the first transport roller 44.

In contrast, in the structure of the exemplary embodiment, the first transport roller 44 is shifted in only the leftward direction, not in both of the rightward and leftward directions. For this reason, compared with the structure illustrated in FIGS. 8A to 8E, variations in behavior of the first transport roller 44 during movement are reduced. Hence, in the structure of the exemplary embodiment, the position of the sheet P after movement does not vary, compared with the structure of FIGS. 8A to 8E. This prevents the image forming position from varying among sheets.

In the exemplary embodiment, as described above, the sheet P is transported along the first sheet transport path R1 so that the center portion of the sheet P is aligned with the transport reference HK1. If the transport reference HK1 is not aligned with the center portions (axial centers) of the transport rollers 48 in such a transport manner, the load acting from the transport rollers 48 on the sheet P is nonuniform in the width direction of the sheet P (direction orthogonal to the transport direction), and this may hinder stable transport of the sheet P. Accordingly, in the exemplary embodiment, the transport rollers 48 are located so that the center portions of the transport rollers 48 are aligned with the transport reference HK1 in the first sheet transport path R1. More specifically, each first rotating member 48B (see FIG. 6B) and each second rotating member 48C are located so that the distance from the first rotating member 48B to the transport reference HK1 is equal to the distance from the second rotating member 48C to the transport reference HK1.

The transport rollers 48 located downstream of the second transfer device 30 (transport rollers 48 provided in the second sheet transport path R2 and the third sheet transport path R3) are arranged so that the center portions thereof are aligned with the transport reference HK2. In other words, the transport rollers 48 are arranged so that the distance between each first rotating member 48B (see FIG. 6E) and the transport reference HK2 is equal to the distance between each second rotating member 48C and the transport reference HK2.

While the second detection is performed by the second side detection sensor SK2 after the first detection is performed by the first side detection sensor SK1 in the above exemplary embodiment, the second detection may be performed by the first side detection sensor SK1 after the first detection is performed by the second side detection sensor SK2. Further, while the detection sensor FS1 is provided in the fourth sheet transport path R4 that connects the first sheet transport path R1 and the third sheet transport path R3, as illustrated in FIG. 3, the fourth sheet transport path R4 is curved in the exemplary embodiment, as illustrated in the figure.

For this reason, a leading end of a curved sheet P is detected by the detection sensor FS1 in the exemplary embodiment, and this may reduce the detection accuracy. Accordingly, as illustrated in FIG. 3, a sensor FS2 may be provided to oppose the linear first sheet transport path R1 so as to detect the leading end of the sheet P that is not curved. While two sensors, that is, the first side detection sensor SK1 and the second side detection sensor SK2 are provided downstream of the first transport roller 44 in the above exemplary embodiment, the sides of the sheet P may be detected by a single sensor in which light receiving elements 40 (see FIG. 4) are arranged from one side to the other side of the sheet P.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A recording-material transport apparatus comprising:

a transport unit that transports a recording material;

a detector that detects a position of the recording material in an intersecting direction intersecting a transport direction in which the recording material is transported by the transport unit;

an abutting member that corrects a skew of the recording material by abutting the recording material against a surface; and a moving member that moves the recording material transported by the transport unit to a predetermined position in the intersecting direction on the basis of a detection result of the detector, a predetermined portion of the recording material between sides of the recording material that are parallel to the transport direction is aligned with a first transport reference on an upstream side of the moving member in the transport direction, and the predetermined portion of the recording material moves along a second transport reference different from but parallel to the first transport reference on a downstream side of the moving member in the transport direction, wherein responsive to the detector detecting that a position of the predetermined portion of the recording material is in on a side of the first transport reference relative to the second transport reference in the intersecting direction, the moving member moves the recording material to align the predetermined portion of the recording material with the second transport reference in the intersecting direction.

2. The recording-material transport apparatus according to claim 1, wherein, when the recording material has a first side and a second side opposite to the first side, the transport unit transports the recording material so that the first side and the second side move along a predetermined transport path, wherein the recording-material transport apparatus further includes a supply unit that turns the recording material upside down to change places of the first side and the second side of the recording material after the recording material is moved in the intersecting direction by the moving member and that supplies the turned recording material to the transport unit on an upstream side of the detector, and wherein the detector detects the position of the recording material in the intersecting direction by detecting the first side of the recording material transported by the transport unit and detects a position of the recording material turned by the supply unit and the transported by the transport unit by detecting the first side again.

3. The recording-material transport apparatus according to claim 1, wherein the transport unit transports the recording material so that a predetermined portion of the recording material moves along a predetermined reference, wherein the recording-material transport apparatus further includes a supply unit that turns the recording material upside down after the recording material is moved in the intersecting direction and that supplies the turned recording material to the transport unit on an upstream side of the detector, and wherein the supply unit supplies the turned recording material to the transport unit so that the predetermined portion of the recording material is aligned with the predetermined reference.

4. The recording-material transport apparatus according to claim 1, wherein the transport unit transports the recording material so that a center portion of the recording material in the intersecting direction moves along a predetermined reference, wherein the transport unit includes a first rotating member to contact with the recording material and a second rotating member to contact with the recording material, the second rotating member being located at a position different from the first rotating member in the intersecting direction, and the transport unit transports the recording material by using the first rotating member and the second rotating member, and wherein the first rotating member and the second rotating member are located so that a distance from the first rotating member to the predetermined reference is equal to a distance from the second rotating member to the predetermined reference.

5. The recording-material transport apparatus according to claim 1, wherein the transport unit transports the recording material along the first transport reference, and after the moving member moves the recording material to the predetermined position in the intersecting direction, the recording material is transported along the second transport reference which is different from but parallel to the first transport reference.

6. The recording-material transport apparatus according to claim 5, wherein the recording material is transported along the first or the second transport reference in a way that a center portion of the recording material is aligned with the first or the second transport reference.

7. A recording-material transport method comprising:

transporting a predetermined portion of a recording material aligned along a first transport reference on an upstream side of a moving member in a transport direction, the predetermined portion being between sides of the recording material that are parallel to a transport direction;

detecting a position of the recording material in an intersecting direction intersecting the transport direction in which the recording material is transported;

correcting a skew of the recording material by abutting the recording material against an abutting member;

moving the recording material to a predetermined position in intersecting direction on the basis of a detection result;

transporting the predetermined portion of the recording material along a second transport reference which is different from but parallel to the first transport reference on a downstream side of the moving member in the transport direction; and moving the recording material to align the predetermined portion of the recording material with the second transport reference in the intersecting direction responsive to a detection result of the detecting step indicating that a position of the predetermined portion of the recording material is on a side of the first transport reference relative to the second transport reference in the intersecting direction.

8. The recording-material transport method according to claim 7, wherein the recording material is transported along the first or the second transport reference in a way that a center portion of the recording material is aligned with the first or the second transport reference.

* * * * *